US007196602B2

(12) United States Patent
Adams et al.

(10) Patent No.: US 7,196,602 B2
(45) Date of Patent: Mar. 27, 2007

(54) SOLENOID

(75) Inventors: Ross R. Adams, Carlton, GA (US); B. Thomas Wheless, Lexington, GA (US)

(73) Assignee: Macon Electric Coil Company, St. Louis, MO (US)

( * ) Notice: Subject to any disclaimer, the term of this patent is extended or adjusted under 35 U.S.C. 154(b) by 0 days.

(21) Appl. No.: 11/129,866

(22) Filed: May 16, 2005

(65) Prior Publication Data

US 2006/0255892 A1 Nov. 16, 2006

(51) Int. Cl.
*H01F 3/00* (2006.01)
*H01F 7/08* (2006.01)

(52) U.S. Cl. ..... 335/264; 335/229; 335/255; 335/265

(58) Field of Classification Search ..... 335/229, 335/234, 236, 259, 264, 265, 267
See application file for complete search history.

(56) References Cited

U.S. PATENT DOCUMENTS 3,647,177 A 3/1972 Lang
4,587,506 A * 5/1986 Hoeksma ..... 336/178
5,365,210 A * 11/1994 Hines ..... 335/238
5,497,135 A * 3/1996 Wisskirchen et al. ..... 335/253
5,947,155 A 9/1999 Miki et al.
6,002,184 A 12/1999 Delson et al.
6,422,533 B1 7/2002 Harms

OTHER PUBLICATIONS

Lequesne, Bruno; "Fast-Acting Long-Stroke Bistable Solenois with Moving Permanent Magnets"; IEEE Transactions on Industry Applications, vol. 26, No. 3, May/Jun. 1990, p. 401-407.

* cited by examiner

*Primary Examiner*—Ramon M. Barrera
(74) *Attorney, Agent, or Firm*—Polster, Lieder, Woodruff & Lucchesi, LC

(57) ABSTRACT

A solenoid is provided which, in the preferred embodiment, has a bobbin having an axial opening in it. A divider is mounted within the opening. Respective ones of a first pole piece and a second pole piece are located on opposite sides of the divider. A permanent magnet is moveably mounted from the axial opening and is moveable independently of the second pole piece between at least a first position adjacent to the divider, and a second position adjacent the second pole piece. The construction provides a fast acting, low cost latching solenoid construction.

18 Claims, 3 Drawing Sheets

SOLENOID

CROSS REFERENCE TO RELATED APPLICATIONS

None

STATEMENT REGARDING FEDERALLY SPONSORED RESEARCH OR DEVELOPMENT

N/A

BACKGROUND OF THE INVENTION

This invention relates to solenoid constructions, and in particular, to a low cost solenoid having improved operating characteristics. While the invention is described in particular detail with respect to certain preferred applications of the solenoid, those skilled in the art will recognize the wider applicability of the inventive principles disclosed hereinafter.

A conventional solenoid is designed so that magnetic force is exerted across an air gap generally perpendicular to the pole pieces in such a manner as to close the gap. Latching solenoids also are well known in this device, wherein a plunger moves from its first to second position. The plunger is maintained in the second position until a physical force is exerted on the plunger to return it to its initial starting position.

We have determined that a relatively efficient, and low cost solenoid construction can be obtained by utilizing in its simplest form, a freely moveable permanent magnet which operates between first and second pole pieces to operate the solenoid in a unique fashion. In this construction, a divider separates the first and second pole pieces.

SUMMARY OF THE INVENTION

The present invention relates to a solenoid construction. In an embodiment, the present invention relates to a bobbin having an axial length, an external surface and an axial opening extending through the axial length. The bobbin comprises a divider mounted in the axial opening of the bobbin, which divides the axial opening into a first segment and a second segment. A first pole piece is moveable within the first segment between a retracted position and an extended position while a second pole piece is moveable within the second segment between an external position external of the axial opening and an internal position within the axial opening.

A permanent magnet is movable within the second segment between a first position adjacent the second pole piece when the second pole piece is positioned in the external position and a second position adjacent the divider. In the second position, the permanent magnet position magnetically draws the first pole piece from the retracted position to the extended position to magnetically couple the first pole piece to the permanent magnet.

In an embodiment, the present invention relates to method of operating the solenoid. The method of operation comprises segmenting the bobbin by a divider to form a first segment and a second segment. Next, a force is applied to the permanent magnet while the permanent magnet is disposed within the second segment to reciprocate the permanent magnet between a first position and a second position. The permanent magnet magnetically draws the first pole piece through the first segment toward the permanent magnet in order to magnetically couple the first pole piece to the permanent magnet in its second position. The divider separates the first pole piece and the permanent magnet. The force is then reapplied to the permanent magnet in order to reciprocate the permanent magnet through the second segment from the second position to the first position and to retract the first pole piece.

BRIEF DESCRIPTION OF THE DRAWINGS

The objects of the invention are achieved as set forth in the illustrative embodiments shown in the drawings, which form a part of this specification.

Corresponding reference characters indicate corresponding parts throughout the several views of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention including what we presently believe is the best mode of carrying out the invention. As various changes could be made in the constructions discussed herein without departing from the scope of the invention, it is intended that all matter contained in the description are shown in the accompanying drawings shall be interpreted as illustrative and not in a limited sense.

Figure 1:
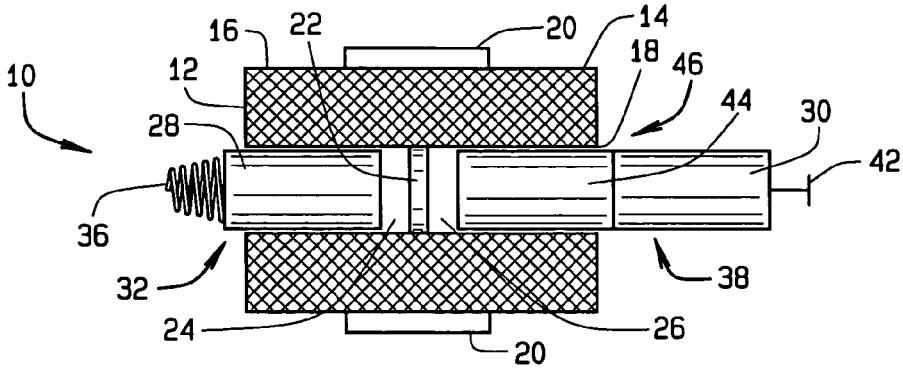
FIG. 1 is a cross sectional view of an operating condition of one illustrative embodiment of a bobbin of the solenoid of the present invention.

Referring now to FIG. 1, reference numeral 10 indicates one illustrative embodiment of solenoid of the present invention wherein the solenoid 10 includes a bobbin 12 having an axial length 14, an external surface 16 and an axial opening 18 extending through the axial length 14. As known in the art, electrical coil 20 winds about the bobbin 12 along the external surface 16.

A divider 22 mounted in the axial opening 18 divides the axial opening 18 into a first segment 24 and a second segment 26. In an embodiment, the first segment 24 and the second segment 26 may have the same length. The segments 24, 26, though, may be of any length depending on the construction, strength and package size of the solenoid 10.

Figure 3:
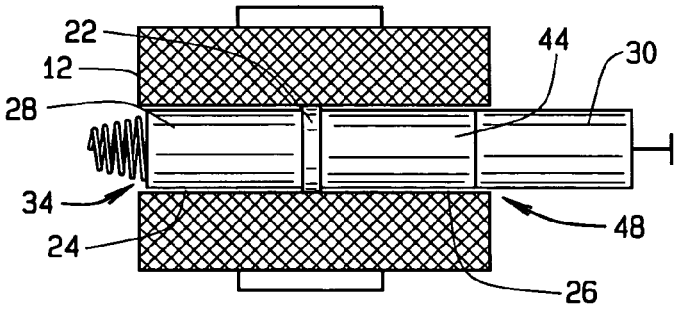
FIG. 3 is cross sectional view of a third operating condition of the bobbin of the present invention.

The bobbin 12 further includes a first pole piece 28 and a second pole piece 30 positioned on opposite sides of the divider 22. As shown, the first pole piece 28 is movable within the first segment 24 between a retracted position 32 and an extended position 34 (FIG. 3). In the retracted position 32, the first pole piece 28 does not contact the divider 22. As such, a mechanical device 36 attaches to the first pole piece 28 to retract the first pole piece 28 axially outward from the divider 22 in the retracted position 32. In an embodiment, the mechanical device 36 may comprise a spring such as, but not limited to, a coil compression spring. The mechanical device 36 connects with a portion (not shown) of the solenoid 10.

Figure 2:
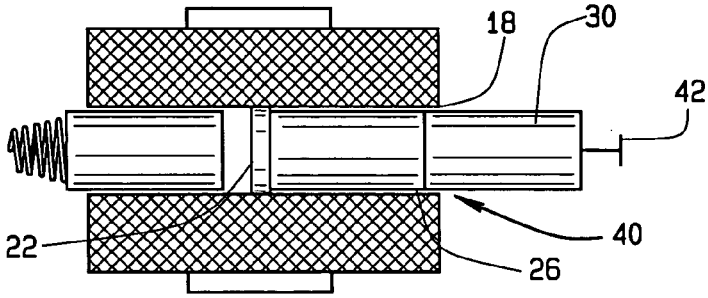
FIG. 2 is a cross sectional view of a second operating condition of the bobbin of the present invention.

Turning to FIG. 2 and referring to FIG. 1, the second pole piece 30 is moveable within the second segment 26 between an external position 38 (FIG. 1) and an internal position 40. In the external position 38, the second pole piece 30 may be fixed with respect to the bobbin 14. In the internal position 40, portions of the second pole piece 30 project into the axial opening 18. In an embodiment, a manual connection 42 such as an actuator may reciprocate the second pole piece 30 between the external position 38 and the internal position 40.

Referring to FIG. 3, the bobbin 12 further comprises a permanent magnet 44, which is moveable within the second segment 26 between at least a first position 46 (FIG. 1) and a second position 48. In the first position 46, the permanent magnet 44 magnetically couples with the second pole piece 30 when the second pole piece 30 is positioned in the external position 38 as shown in FIG. 1. In the second position 48, the permanent magnet 44 is positioned adjacent to the divider 22. In this position, the permanent magnet 44 magnetically draws the first pole piece 28 from the retracted position 32 (FIG. 1) to the extended position 34 to magnetically couple the first pole piece 28 to the permanent magnet 44 as will be discussed.

Figure 4:
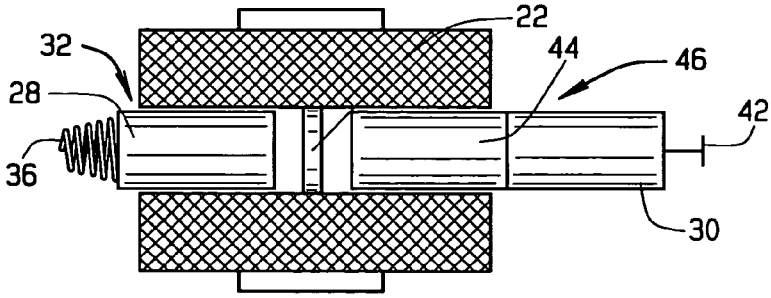
FIG. 4 is a cross sectional view of a fourth operating condition of the bobbin of the present invention.

As shown in FIG. 4, when the permanent magnet 44 reciprocates back to the first position 46 and adjacent the second pole piece 30, the mechanical device 36 retracts the first pole piece 28 to its retracted position 32. As such, the bobbin 12 of the solenoid 10 incorporates a freely moveable permanent magnet 44, which operates between first and second pole pieces 28, 30 while the divider 22 separates the first and second pole pieces 28, 30.

Referring to FIGS. 1–4, a manual method of operation of the present invention is shown. During operation, the divider 22 segments the bobbin 12 to form the first segment 24 and the second segment 26. As shown in FIG. 1, the mechanical device 36 retracts the first pole piece 28 to its retracted position 32. Additionally, the manual connection 42 positions the second pole piece 30 in the external position 38. In this position, the permanent magnet 44 magnetically couples to the second pole piece 30 in the first position 46 of the permanent magnet 44.

Turning to FIG. 2, the manual connection 42 actuates the second pole piece 30 to apply a force to the permanent magnet 44 while the permanent magnet 44 is disposed within the second segment 26 to reciprocate the permanent magnet 44 between the first position 46 and the second position 48. As such, actuating the second pole piece 30 moves the coupled permanent magnet 44 and second pole piece 30 to the second position 48. In the second position 48, the permanent magnet 44 moves adjacent to the divider 22.

Referring to FIG. 3, the permanent magnet 44 in the second position 48 magnetically draws the first pole piece 28 through the first segment 24 toward the permanent magnet 44 and adjacent the divider 22. Accordingly, the first pole piece 28 moves to its extended position 34 within the first segment 24. The first pole piece 28 magnetically couples to the permanent magnet 44 through the divider 22 when the permanent magnet 44 is in the second position 48. The first pole piece 28, the second pole piece 30 and the permanent magnet 44 will remain in this configuration until acted upon by another force.

As shown in FIG. 4, a force may be reapplied to the permanent magnet 44 which reciprocates the permanent magnet 44 and breaks the magnetic couple between the first pole piece 28 and the permanent magnet 44. As such, the first pole piece 28 retracts through the first segment 24 via the mechanical device 36 while the permanent magnet 44 reciprocates through the second segment 26 from the second position 48 to the first position 46. In an embodiment, reapplying the force to the permanent magnet 44 comprises actuating the second pole piece 30 via the manual connection 42 to move the coupled permanent magnet 44 and second pole piece 30 to the second position 48 which is separate from the divider 22. Moving the coupled permanent magnet 44 decouples the first pole piece 28 from the permanent magnet 44 such that the first pole piece 28 moves to the retracted position 32. As such, solenoid 10 of the present invention may use a manual operation by actuating the manual connection 42.

Figure 5:
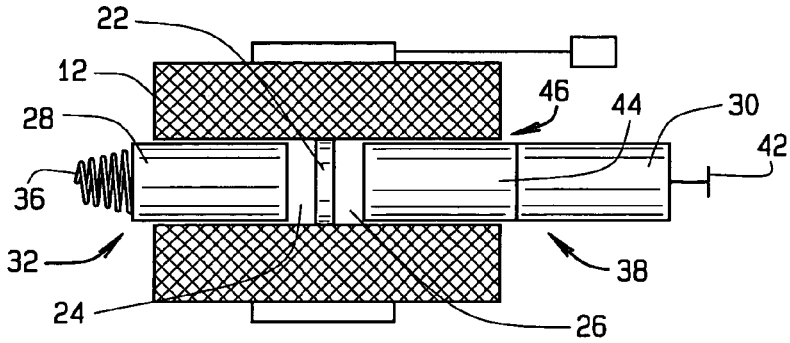
FIG. 5 is a cross sectional view of another operating condition of another illustrative embodiment of the bobbin of the present invention.

Referring to FIGS. 5–8, an automatic method of operation of the present invention is shown. During this operation, the divider 22 segments the bobbin 12 to form the first segment 24 and the second segment 26. As shown in FIG. 5, the mechanical device 36 retracts the first pole piece 28 to its retracted position 32. Additionally, the manual connection 42 positions the second pole piece 30 in the external position 38. In this embodiment, the second pole piece 30 remains fixed in the external position 38. Furthermore, in this position, the permanent magnet 44 magnetically couples to the second pole piece 30 in the first position 46 of the permanent magnet 44.

Figure 6:
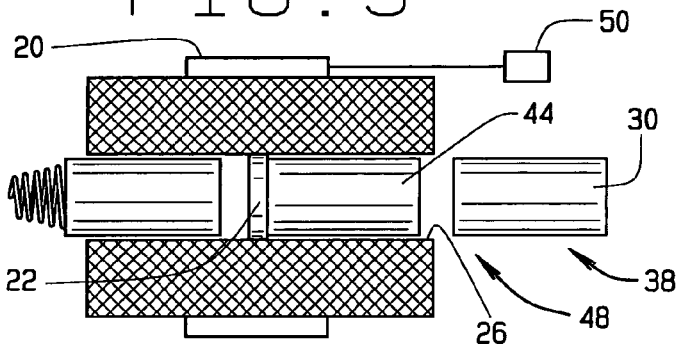
FIG. 6 is cross sectional view of a second operating condition of the bobbin of FIG. 5.

Turning to FIG. 6, the solenoid 10 applies a force to the permanent magnet 44 while the permanent magnet 44 is disposed within the second segment 26 to reciprocate the permanent magnet 44 between the first position 46 and the second position 48. In an embodiment, applying the force to the permanent magnet 44 comprises creating a magnetic filed having the same polarity as the permanent magnet 44. The solenoid 10 may create the magnetic field by energizing the electrical coils 20 with a small amount of current. In an embodiment, a power control device 50 attached to the electrical coil 20 may supply the current to the electrical coil 20. Since the second pole piece 30 remains fixed in its external position 38, the permanent magnet 44 decouples from the second pole piece 30 as the permanent magnet 44 moves to the second position 48. As such, applying the force moves the permanent magnet 44 to the second position 48 that is adjacent the divider 22.

Figure 7:
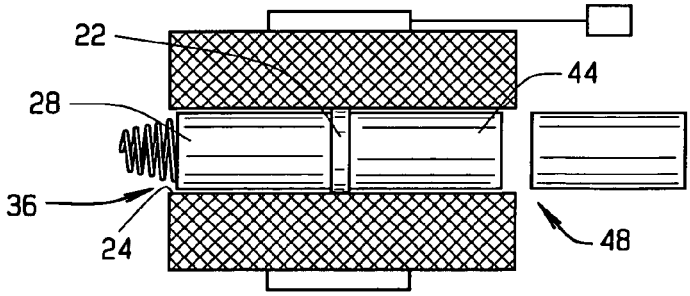
FIG. 7 is cross sectional view of a third operating condition of the bobbin of FIG. 5.

Referring to FIG. 7, the permanent magnet 44 in the second position 48 magnetically draws the first pole piece 28 through the first segment 24 toward the permanent magnet 44 and adjacent the divider 22. Accordingly, the first pole piece 28 moves to its extended position 34 within the first segment 24. The first pole piece 28 magnetically couples with the permanent magnet 44 through the divider 22 when the permanent magnet 44 is in the second position 48. The first pole piece 28, the second pole piece 30 and the permanent magnet 44 will remain in this configuration until acted upon by another force.

Figure 8:
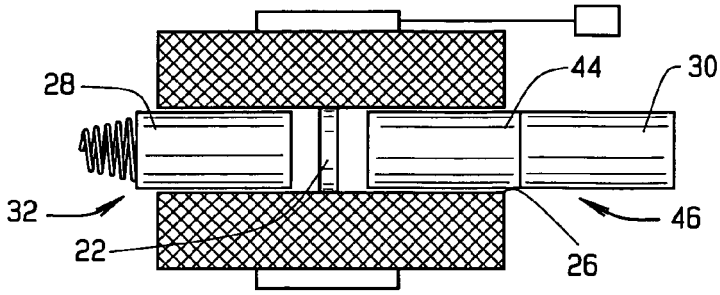
FIG. 8 is cross sectional view of a fourth operating condition of the bobbin of FIG. 5.

As shown in FIG. 8, a force may be reapplied to the permanent magnet 44 that breaks the magnetic couple of the first pole piece 28 and the permanent magnet 44 across the divider 22. As such, the first pole piece 28 retracts through the first segment 24 while the permanent magnet 44 reciprocates through the second segment 26 from the second position 48 to the first position 46. Accordingly, moving the coupled permanent magnet 44 decouples the first pole piece 28 from the permanent magnet 44 such that the first pole piece 28 moves to the retracted position 32.

In an embodiment, reapplying the force applied to the permanent magnet 44 comprises creating another magnetic field having the opposite polarity of the permanent magnet 44 wherein the other magnetic field reciprocates the permanent magnet 44 back to the first position 46. At the first position 46, the permanent magnet 44 magnetically couples with the second pole piece 30. In another embodiment, reapplying the force applied to the permanent magnet 44 comprises de-energizing the electrical coil 20 such that the permanent magnet 44 magnetically couples again to the second pole piece 30. As such, the solenoid 10 of the present invention may use an automatic operation by energizing the electrical coil 22. In another embodiment, reapplying the force may comprise activating the manual connection 42 to move the second pole piece 30 in magnetic contact with the permanent magnet 44 and then retracting the permanent magnet 44 and second pole piece 30.

Figure 9:
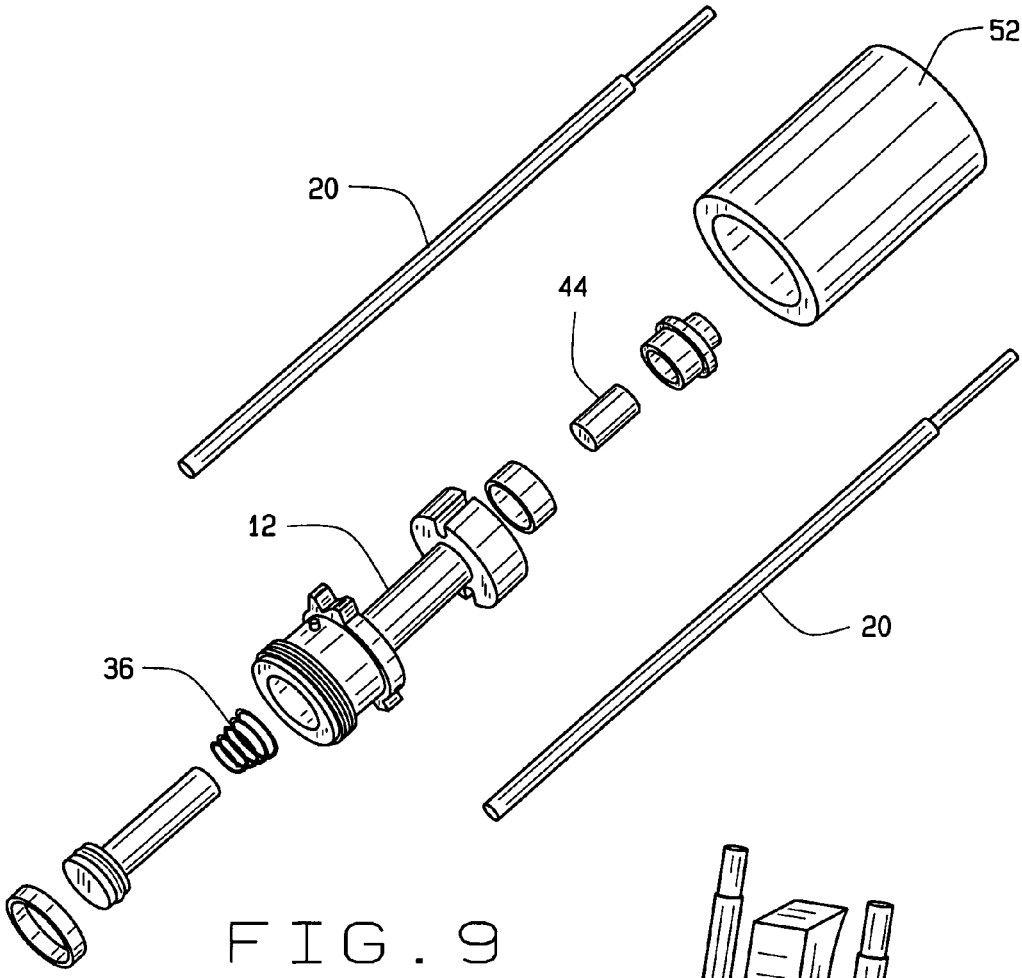
FIG. 9 is a breakaway perspective view of components of one illustrative embodiment of the solenoid of the present invention.
Figure 10:
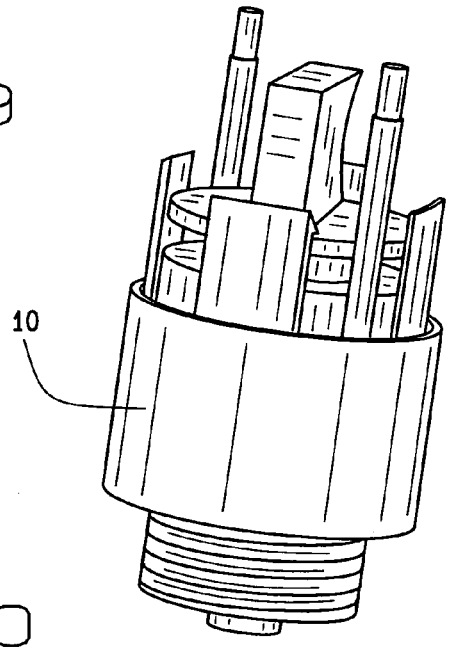
FIG. 10 is a perspective view of one illustrative embodiment of the solenoid of the present invention.

Turning to FIGS. 9 and 10, an embodiment of the present invention is shown. FIG. 9 illustrates in a perspective breakaway view components of the present invention. As shown, the solenoid 10 includes a protective cover mold 52 of non-electrically conductive material that surrounds at least the electrical coil 20. Additionally, FIG. 9 illustrates the bobbin 12, permanent magnet 44 and mechanical device 36 along with other components. FIG. 10 illustrates an embodiment of the solenoid 10 in assembled form.

In view of the above, it will be seen that the several objects of the disclosure are achieved and other advantageous results are obtained. As various changes could be made in the above constructions without departing from the scope of the disclosure, it is intended that all matter contained in the above description or shown in the accompanying drawings shall be interpreted as illustrative and not in a limiting sense.

What is claimed is:

1. A bobbin having an axial length, an external surface and an axial opening extending through the axial length, comprising:

a divider mounted in the axial opening of the bobbin to divide the axial opening into a first segment and a second segment;

a first pole piece moveable within the first segment between a retracted position and an extended position;

a second pole piece moveable within the second segment between an external position external of the axial opening and an internal position within the axial opening; and a permanent magnet movable within the second segment between a first position adjacent the second pole piece when the second pole piece is positioned in the external position and a second position adjacent the divider, wherein the permanent magnet in the second position magnetically draws the first pole piece from the retracted position to the extended position to magnetically couple the first pole piece to the permanent magnet.

2. The bobbin of claim 1 further comprising an electrical coil wound about the bobbin along the external surface thereof.

3. The bobbin of claim 2 further comprising a power control device attached to an end of the electrical coil.

4. The bobbin of claim 1 further comprising a mechanical device attached to the first pole piece, the mechanical device retracting the first pole piece axially outward from the divider in the retracted potion.

5. The bobbin of claim 4 wherein the mechanical device attached to the first pole piece is a spring.

6. The bobbin of claim 5 wherein the spring is a coil compression spring.

7. The bobbin of claim 1 further comprising a manual connection which reciprocates the second pole piece between the external position and the internal position of the second pole piece.

8. The bobbin of claim 1 wherein the first segment and the second segment are equal in length to one another.

9. A solenoid, comprising:

a bobbin having an axial length, an external surface and an axial opening extending through the axial length;

an electrical coil wound about the bobbin along the external surface thereof;

a divider mounted in the axial opening of the bobbin to divide the axial opening into a first segment and a second segment;

a first pole piece moveable within the first segment between a retracted position and an extended position;

a mechanical device attached to the first pole piece, the mechanical device retracting the first pole piece axially outward from the divider in the retracted potion;

a second pole piece moveable within the second segment between an external position external of the axial opening and an internal position within the axial opening; and a permanent magnet movable within the second segment between a first position adjacent the second pole piece when the second pole piece is positioned in the external position and a second position adjacent the divider, wherein the permanent magnet in the second position magnetically draws the first pole piece from the retracted position to the extended position to magnetically couple the first pole piece to the permanent magnet.

10. The solenoid of claim 9 further comprising a power control device attached to an end of the electrical coil.

11. The solenoid of claim 9 further comprising a manual connection which reciprocates the second pole piece between the external position and the internal position of the second pole piece.

12. A method of operating a solenoid having a first pole piece, a second pole piece and a permanent magnet within a bobbin, comprising:

segmenting the bobbin by a divider to form a first segment and a second segment;

applying a force to the permanent magnet while the permanent magnet is disposed within the second segment to reciprocate the permanent magnet between a first position and a second position;

magnetically drawing the first pole piece through the first segment toward the permanent magnet in order to magnetically couple the first pole piece to the permanent magnet as the the permanent magnet moves toward the second position; and reapplying the force applied to the permanent magnet in order to reciprocate the permanent magnet through the second segment from the second position to the first position.

13. The method of operating the solenoid of claim 12 further comprising magnetically coupling the permanent magnet to the second pole piece.

14. The method of operating the solenoid of claim 13 wherein applying the force to the permanent magnet comprises actuating the second pole piece to move the coupled permanent magnet and second pole piece to the second position.

15. The method of operating the solenoid of claim 14 wherein reapplying the force applied to the permanent magnet comprises actuating the second pole piece to move the coupled permanent magnet and second pole piece to the first position, wherein moving the coupled permanent magnet decouples the first pole piece from the permanent magnet such that the first pole piece moves to the retracted position.

16. The method of operating the solenoid of claim 13 wherein applying the force to the permanent magnet comprises creating a magnetic field having the same polarity as the permanent magnet wherein the magnetic field decouples the permanent magnet from the second pole piece and moves the permanent magnet to the second position which is adjacent to the divider.

17. The method of operating the solenoid of claim 16 wherein reapplying the force applied to the permanent magnet comprises creating another magnetic field having the opposite polarity as the permanent magnet wherein the other magnetic field moves the permanent magnet to the first position.

18. The method of operating the solenoid of claim 16 wherein creating the magnetic field comprises energizing an electrical coil which is wound about the bobbin.

* * * * *

UNITED STATES PATENT AND TRADEMARK OFFICE

CERTIFICATE OF CORRECTION

PATENT NO. : 7,196,602 B2
APPLICATION NO. : 11/129866
DATED : March 27, 2007
INVENTOR(S) : Ross R. Adams and Thomas Wheless It is certified that error appears in the above-identified patent and that said Letters Patent is hereby corrected as shown below:

Col. 6, line 62

Replace "the the"
With -- the --

Signed and Sealed this

Seventh Day of August, 2007

JON W. DUDAS
*Director of the United States Patent and Trademark Office*